United States Patent [19]

Seely

[11] 4,152,876

[45] May 8, 1979

[54] METHOD OF MAKING AND INSTALLING TRIMMABLE INSULATED STEEL FACED ENTRY DOOR

[75] Inventor: James R. Seely, Troy, Mich.

[73] Assignee: The Stanley Works, New Britain, Conn.

[21] Appl. No.: 877,709

[22] Filed: Feb. 14, 1978

[51] Int. Cl.[2] ..... E06B 3/36

[52] U.S. Cl. ..... 52/455; 49/503

[58] Field of Search ..... 52/455; 49/503, 501

[56] References Cited

U.S. PATENT DOCUMENTS

| | | | |
|---|---|---|---|
| 990,151 | 4/1911 | Mayo | 49/503 |
| 3,512,305 | 5/1970 | Multer | 49/503 |

FOREIGN PATENT DOCUMENTS

| | | | |
|---|---|---|---|
| 95514 | 2/1960 | Norway | 49/503 |

*Primary Examiner*—J. Karl Bell

[57] ABSTRACT

A metal faced door for use as a replacement in existing door frame installations comprises a wooden frame providing a central cavity and pair of metal panels adhered on opposite faces of that frame with a synthetic resin foam core filling the cavity and bonded to both the wooden frame and the metal panels. The stiles of the wooden frame have longitudinally existing channels spaced from the side edges of the frame, and inturned lips on the side margins of the metal panels are fitted into these channels. The metal panels are dimensioned to terminate inwardly from the outer edges of the rails of the frame so that there is a peripheral margin of wood extending completely thereabout. In using this replacement door, it is mounted upon the existing hinges and any areas of interference are noted and trimmed. The location of the existing latch is also noted and the door is provided with the necessary apertures for the knob set and latch which are then mounted thereon.

5 Claims, 6 Drawing Figures

METHOD OF MAKING AND INSTALLING TRIMMABLE INSULATED STEEL FACED ENTRY DOOR

BACKGROUND OF THE INVENTION

For many years, residential exterior doors have been fabricated from wood with attendant disadvantages from the standpoint of insulating characteristics and tendencies to warp or delaminated More recently, insulated metal faced doors have experienced increasing usage for residential applications since such doors may include insulating cores limiting heat loss and since they also provide greater security and resistance to surface damage. Moreover, magnetic weather stripping can be combined with such metal faced doors so as to further improve the insulating characteristics within the door opening.

Generally, however, such metal faced doors have not been able to make any significant penetration into the market for replacement doors in existing door frame installations. In mounting replacement doors, it is just generally necessary to custom fit the door to the frame since the hinges and latch must be matched and since the frame may be skewed. Thus, trimming has been an essential aspect of fitting replacement doors and such trimming has not been feasible with conventional metal faced doors.

It is an object of the present invention to provide a novel method for making and installing an insulated metal faced entry door which will permit facile trimming to fit existing door frame installations.

It is also an object to provide such a method wherein the metal panels of the door are securely bonded to a peripheral wooden frame and cooperate therewith to provide a flush appearance for both faces of the door.

Another object is to provide such a method wherein the metal faces of the door are totally insulated from each other by a synthetic resin foam core, and the frame includes a reinforcement portion for firmly seating the knob and latch set.

Still another object is to provide a simple, effective and rapid method for mounting metal faced doors in existing door frame installations.

SUMMARY OF THE INVENTION

It has now been found that the foregoing and related objects may be readily obtained by a metal faced door adapted for use as a replacement door in existing door frames comprising a wooden frame including a pair of stiles and a pair of rails extending between the ends of the stiles. The stiles and rails each have inner and outer surfaces and front and rear faces, and the define a rectangular body with a cavity therewithin. The stiles have channels extending along the length thereof spaced inwardly from the outer surfaces a distance of at least one-fourth inch. Disposed on opposite sides of the wooden frame and overlying portions of the stiles and rails are a pair of metal panels having inturned lips extending along the side margins thereof seated in the channels of the stiles. The upper and lower margins of the panels are spaced from the outer surfaces of the rails a distance of at least one-fourth inch.

Filling the cavity of the frame is a synthetic resin foam core which is bonded to the inner surfaces of the stiles and rails and to the metal panels. The metal panels are adhered to the front and rear faces of the stiles and rails by suitable means. As a result, the portions of the stiles and rails extending beyond the margins of the metal panels permit trimming of all edges of the door to enable mounting in an existing door frame installation.

In the preferred embodiment, the stiles have recesses in their front and rear faces cooperatively dimensioned with and seating the overlying portions of the metal panels to provide a flush surface appearance. The rails also have recesses in their front and rear faces cooperatively dimensioned with and seating the overlying portions of the metal panel to provide a flush surface appearance. Desirably, the frame includes a support block within the cavity at one stile thereof intermediate the length thereof and affixed thereto, to provide a rigid mounting for a knob set. The adhering means conveniently comprises an adhesive coating, and preferably, the margins of the metal panels are spaced from the outer surfaces of the frame a distance of about one-half inch.

In the method of mounting the replacement metal faced doors in existing door frame installations, the door to be replaced is removed from the frame of the existing door installation while leaving the hinges mounted upon the jamb of the door frame. The replacement door is placed in the open position in the door frame and the alignment of the hinges is marked thereon. Portions of the stile are removed to mortise hinges, and the door is mounted upon them. The door is moved towards the closed position and areas of interference with the jambs and header of the door frame and the floor surface are noted. The stiles and rails of the replacement door are trimmed to eliminate these areas of interference. The location of the latch is then marked on the door, and apertures are formed in the door for a knob set and latch, and they are then mounted thereon.

DETAILED DESCRIPTION OF THE ILLUSTRATED EMBODIMENT

Figure 1:
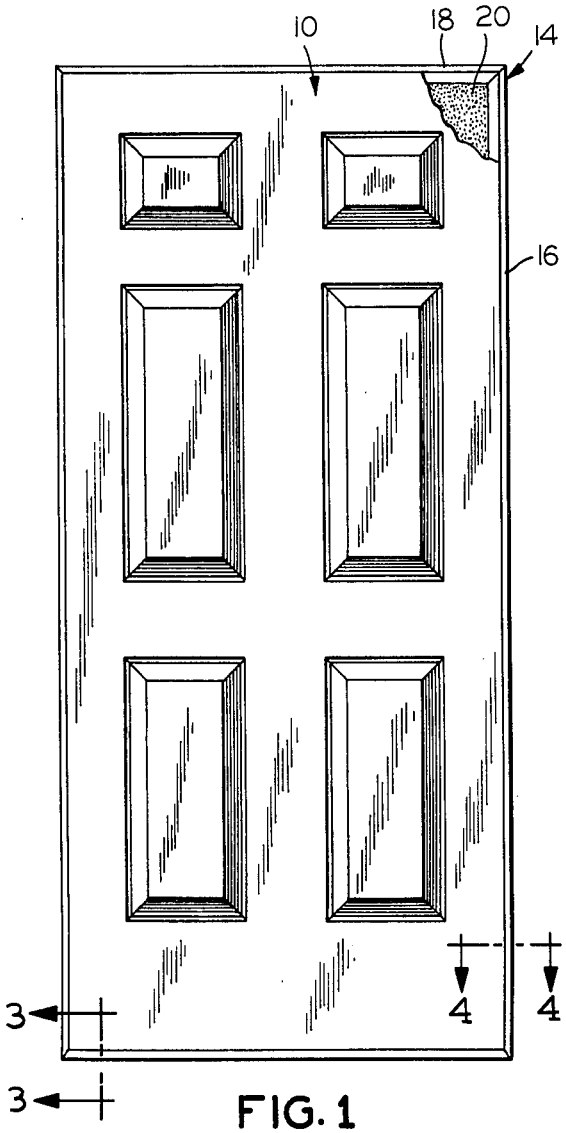
FIG. 1 is a front elevational view of a replacement metal faced door fabricated in accordance with the present invention and with a portion of one metal panel broken away to reveal internal construction.

Turning now to FIG. 1 of the attached drawings, therein illustrated is a replacement metal faced door embodying the present invention and including an outer metal panel generally designated by the numberal 10, a wooden frame generally designated by the numberal 14 and comprised of stiles 16 and rails 18 and a foam core 20.

Figure 2:
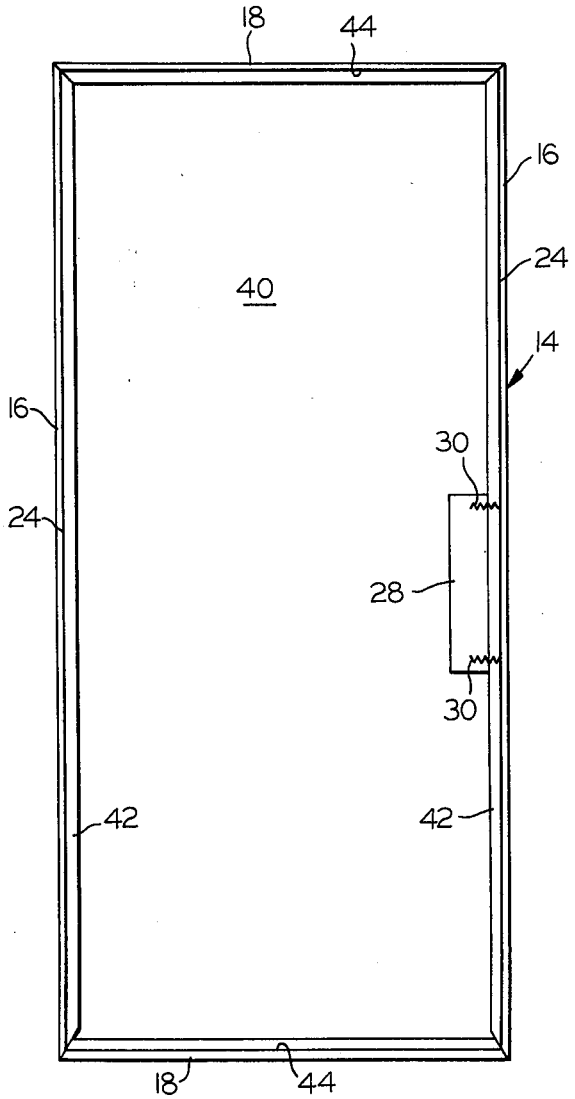
FIG. 2 is a front elevational view of the wooden frame for the door of FIG. 1.
Figure 3:
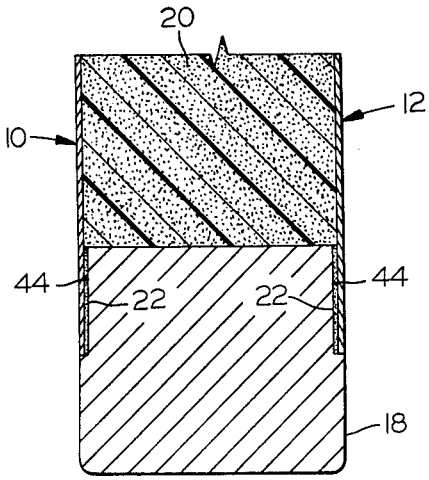
FIG. 3 is a fragmentary sectional view to an enlarged scale along the line 3—3 of FIG. 1.
Figure 4:
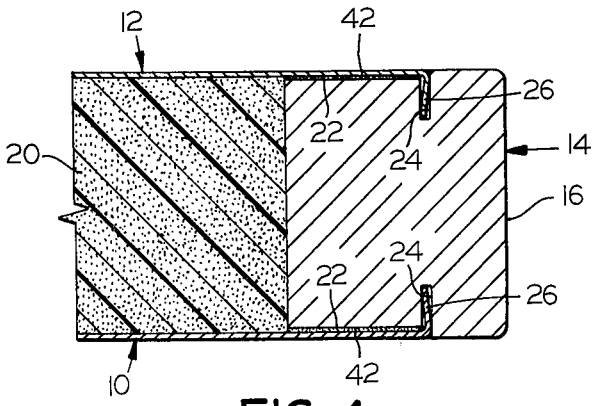
FIG. 4 is a fragmentary sectional view to an enlarged scale along the line 4—4 of FIG. 1.

The wooden frame 14 for the door of FIG. 1 is best seen in FIG. 2 and includes the parallel stiles 16 which, as best seen in FIG. 4, have aligned channels 24 in their front and rear faces extending over the entire length thereof. The rails 18 extend between the ends of the stiles 16, and the several structural members are provided with beveled edges to provide a flush and firm joint. The ends of the stiles 16 and rails 18 are secured together conveniently by both adhesive and fasteners (not shown). Secured to the right hand stile 16 as seen in FIG. 2 by the fasteners 30 is a latch support block 28 which extends a substantial distance in the area of general placement for the knob set and latch 36 (seen in FIG. 6) for a purpose to be described more fully hereinafter. The stiles 16 and rails 18 together define a cavity 40 which subsequently is filled with the synthetic resin foam core 20 as seen in FIGS. 1, 3, and 4.

The metal panels 10, 12 are desirably embossed to provide a panelled appearance as seen in FIG. 1 and have inturned lips 26 formed along their sides which snap into the channels 24 of the stiles 16.

Turning now to FIGS. 3 and 4, the front and rear faces of the stiles 16 are provided with recesses 42 extending from the inner surfaces or edges to the channels 24 and of a depth substantially equal to the thickness of the metal panels 10, 12 so that, upon assembly, the metal panels 10, 12 will lie flush with the peripheral portion of the stiles 16. Similarly, the rails 18 are provided with recesses 44 in their front and rear faces extending from their inner surfaces or edges to provide a flush surface with the overlying metal panels 10, 12. The metal panels 10, 12 are firmly bonded to the stiles 16 and rails 18 by an intermediate coating of adhesive 22, which is exaggerated in thickness for purposes of illustration.

Figure 5:
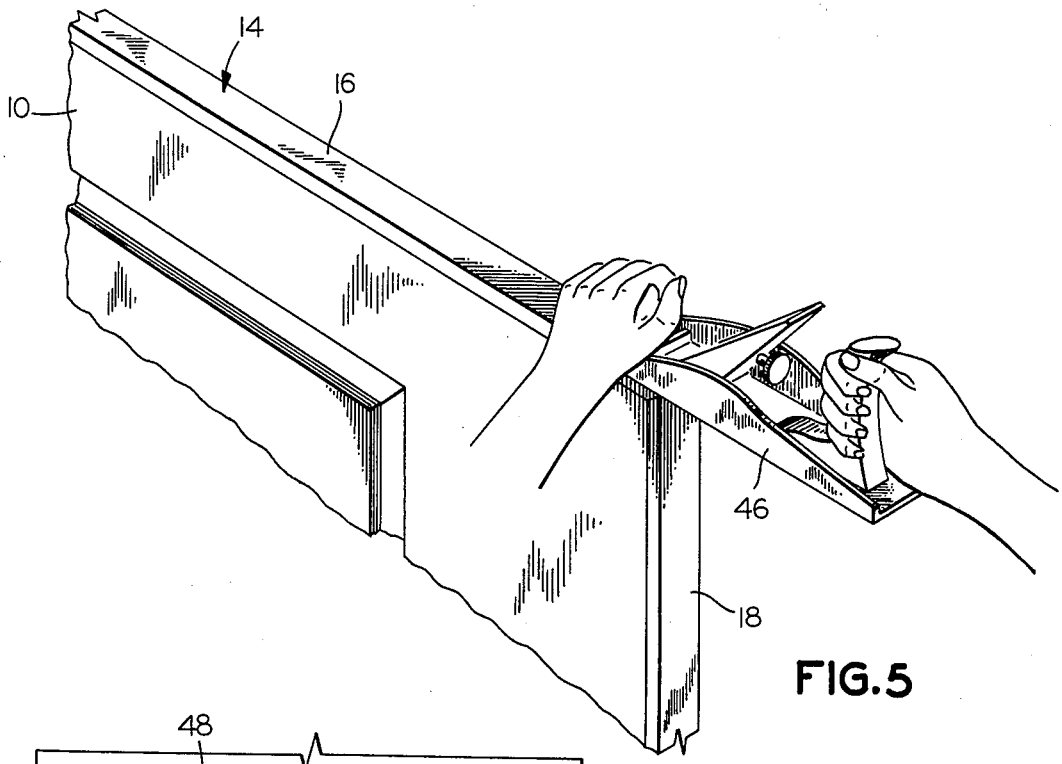
FIG. 5 is a fragmentary perspective view of the door of FIG. 1 showing a workman's hands and a plane in position for trimming the exposed wooden perimeter of the door.

Turning now to FIG. 5, therein illustrated are the hands of a workman trimming the peripheral wooden portion of the door frame 14 by use of a plane 46 so that the door may be fitted with an existing installation (not shown).

Figure 6:
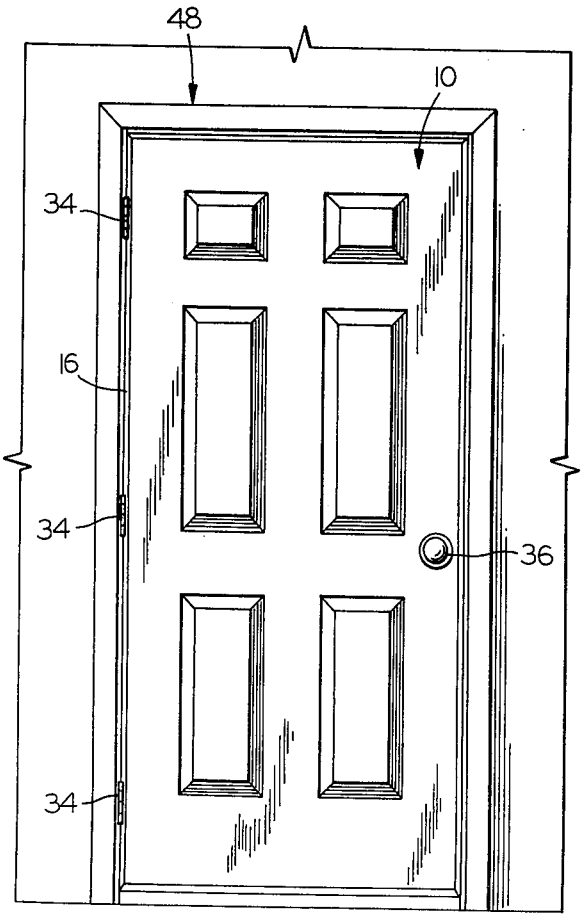
FIG. 6 is a fragmentary rear elevational view of the door of FIG. 1 as mounted in a door frame installation with the hinges and knob set in place, the scale being reduced from that of FIG. 1.

In FIG. 6, the door of FIG. 1 is illustrated as mounted within an existing door frame installation generally designated by the numberal 48. The door has been mounted upon the original hinges 34 which have been mortised into the one stile 16, and the knob set 36 has been mounted in apertures cut into the door so as to be aligned with the existing latch (not shown) on the door jamb.

Turning now to the manner of assembling the door of FIGS. 1–4, the frame 14 is first assembled from the stiles 16 and rails 18 with the ends thereof being secured by adhesive and fasteners (not shown). Prior to assembly, the stiles 16 are provided with the recesses 42 and with the longitudinally extending channels 24, and the rails 18 are provided with the recesses 44. The support block 28 is secured to the one stile 16 by the fasteners 30. The metal panels 10, 12 are formed with lips 26 along the longitudinal edges and with any embossed panel design such as that illustrated. The surfaces of the stiles 16 and rails 18 are coated with a contact adhesive and the periphery of the inner surfaces of the panels 10, 12 is likewise coated with a contact adhesive 22. The metal panels 10, 12 are then assembled to the frame 14 with the lips 26 being seated in the channels 24 of the stiles 16. Pressure is applied to the assembly thus formed to obtain the full bond strength of the adhesive 22.

Following firm adhesion of the metal panels 10, 12 to the frame 14, a synthetic resin mixture is introduced into the cavity 40 through an aperture (not shown) in one of the rails 18 and is foamed in place to provide the foam core 20 which is inherently adherent to the surface of the metal panels 10, 12 and to the inner surface of the frame 14 so as to produce a monolithic structure.

In accordance with conventional practice, the door may be provided with a surface coating of primer or the like following assembly or the individual components may be coated prior to assembly.

In installing the door of the present invention into an existing door frame installation, the old door is initially removed and the door of the present invention is placed into the frame opening in the open portion. At the time of removing the old door, the hinges 34 are left in position upon the door jamb and the position of these hinges is noted upon the stile 16 of the replacement door. This stile is routed to receive the leaves of the hinges 34 and the door is then mounted thereon.

In the next step, the door is slowly moved in the closing direction and the workman notes the areas of interference between the replacement door and the door jambs, or door header, or even the floor in some instances. Once the areas of interference have been determined, the door is removed from the frame and the peripheral portions of the stile 16 and rails 18 are trimmed by planing or the like as seen in FIG. 5. This process may be repeated several times until the door smoothly moves into closing position.

The location of the existing latch upon the door frame is then marked upon the other stile 16. An opening is drilled or otherwise cut through the metal panels 10, 12 and support block 28 to seat the latch set 36 and an aperture is cut through the stile 16 and support block 28 to the first aperture to complete the latch assembly. The bolt and the knob and latch set 36 are then assembled to the door and the replacement installation is thus completed.

If so desired, other features may be subsequently added to the replacement door assembly including weather stripping, bottom sweeps, dead bolts and peep sights. In addition, the door may be provided with one or more finish coats of paint to match the installation in which placed.

It will be appreciated that the replacement door assembly is one which is attractive while providing the advantages of strength and trimmability since the metal panels are firmly bonded to both the core and the wooden frame, and the panels lie flush with the exposed portions of the underlying wooden frame. Moreover, for swing-in doors, the joint line between the wood and the metal panels is concealed by the jamb stops when the door is viewed from the exterior.

It will be appreciated that the monolithic character of the door ensures a rugged, long lived assembly and the spacing of the metal panels from each other by the wood frame and by the insulating foam core minimizes heat transfer therethrough. Since the hinges can be mortised at any place along the length of the appropriate stile and since the knob and latch set may be located over the substantial length of the support block of the wooden frame, a wide variation in existing door frame assemblies can be readily accommodated.

To provide the necessary area for trimming to meet a wide variety of possible conditions in the field, the metal panels preferably terminate inwardly from the outer surfaces of the stiles and rails a distance of at least about $\frac{1}{4}$ inch and preferably on the order of $\frac{1}{2}$ inch. Spacings greater than $\frac{3}{4}$ inch do not appear to serve any useful purpose and do detract from the unitary appearance of the metal faced door assembly.

In view of the foregoing detailed specification and attached drawings, it can be readily appreciated that the replacement doors of the present invention permit facile trimming to fit existing door frame installations by a method which is simple, effective and rapid. The metal panels are securely bonded to the wooden frame in a monolithic structure, and cooperate therewith to provide a flush appearance. The metal panels are totally insulated from each other by the synthetic resin foam core so as to provide good insulating properties for the door.

Having thus described the invention, I claim:

1. In the method of mounting replacement metal faced doors in existing door frame installations, the steps comprising:

A. forming a wooden frame including a pair of stiles and a pair of rails extending between the ends of the stiles so as to define a rectangular body with a cavity therewithin, the stiles and rails having inner and outer surfaces and front and rear faces, said stiles being formed with channels extending along the length thereof and spaced inwardly from the outer surface thereof a distance of at least one-fourth inch;

B. placing a pair of metal panels on the opposite sides of said frame, the side margins of said panels having inturned lips extending along the length thereof which are fitted into said channels of said stiles, the top and bottom margins of said panels terminating inwardly of said outer surfaces of the rails a distance of at least one-fourth inch;

C. adhering the overlying portions of said panels to said stiles and rails;

D. foaming in place in said cavity a synthetic resin composition to provide a foam core bonded to said panels and to said rails and stiles to provide the replacement door, the rails, stiles, core and metal panels being bonded together in a unitary monolithic structure;

E. removing from the frame of the existing door installation the door to be replaced;

F. trimming said replacement door to fit the frame of said existing door installation; and G. mounting said replacement door upon said frame of said existing door installation 2. The method in accordance with claim 1 wherein the stiles and rails are provided with recesses extending from the inner surfaces thereof cooperatively dimensioned with the overlying metal panels to provide a flush surface appearance upon assembly.

3. The method in accordance with claim 1 wherein a reinforcing wood block is secured to one of said stiles in said cavity and intermediate the length thereof to provide a rigid mounting for a knob set.

4. The method in accordance with claim 1 wherein said stiles and rails are provided with a coating of adhesive on their front and rear faces adjacent the inner surfaces thereof prior to placement of said metal panels thereon.

5. The method in accordance with claim 1 wherein said step of removal of the existing door leaves the hinges mounted upon the jamb of said door frame and wherein said steps of trimming and mounting said replacement door include the following steps:

H. placing said replacement door in the open position in said frame and marking the alignment of said hinges thereon;

I. removing portions of the stile to mortise said hinges;

J. mounting said door on said hinges;

K. moving said door towards closed position and noting areas of inteference with the jambs and header of said door frame and the floor surface;

L. trimming the stiles and rails of said replacement door to eliminate the areas of interference;

M. marking on said door the location of the latch;

N. forming apertures in said door for a knob set and latch; and

O. mounting the knob set and latch on said door.

* * * * *